US008720888B2

(12) United States Patent
Masuda et al.

(10) Patent No.: US 8,720,888 B2
(45) Date of Patent: May 13, 2014

(54) IMAGE FORMING APPARATUS WITH A FEEDING UNIT INCLUDING A PLURALITY OF RIBS

(75) Inventors: Takehiro Masuda, Aichi (JP); Makoto Hattori, Aichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/559,633

(22) Filed: Jul. 27, 2012

(65) Prior Publication Data

US 2013/0026705 A1 Jan. 31, 2013

(30) Foreign Application Priority Data

Jul. 29, 2011 (JP) ..... 2011-166691
May 21, 2012 (JP) ..... 2012-115276

(51) Int. Cl.
*B65H 5/00* (2006.01)
*B65H 5/38* (2006.01)

(52) U.S. Cl.
CPC ..... *B65H 5/38* (2013.01); *Y10S 271/902* (2013.01)
USPC ..... 271/264; 271/186; 271/225; 271/902

(58) Field of Classification Search
USPC ..... 271/225, 264, 186, 902; 399/401
See application file for complete search history.

(56) References Cited

U.S. PATENT DOCUMENTS 6,149,045 A * 11/2000 Kadono ..... 271/225
6,993,282 B2 * 1/2006 Kimizuka ..... 399/401
2009/0295077 A1 12/2009 Murakami et al.
2011/0188913 A1 8/2011 Aoi
2012/0068402 A1 * 3/2012 Campbell et al. ..... 271/225

FOREIGN PATENT DOCUMENTS

JP 2009-179411 8/2009
JP 2009-286587 12/2009
JP 2011-157145 8/2011

* cited by examiner

*Primary Examiner* — Gerald McClain
(74) *Attorney, Agent, or Firm* — Banner & Witcoff, Ltd.

(57) ABSTRACT

An image forming apparatus is provided that includes a turn-around mechanism, and a re-feeding unit that includes a first feeding unit having a guide curved to bulge in such a direction as to be farther from an image forming unit, the guide defining an outer side of a curved first feeding route for feeding a sheet received from the turn-around mechanism, and a second feeding unit defining a second feeding route for feeding the sheet fed via the first feeding route, the guide including a first section on a first side thereof in the width direction of the sheet, and a second section around a second side opposite to the first side thereof in the width direction, the second section being curved to bulge more than the first section in such a direction as to be farther from the image forming unit.

11 Claims, 8 Drawing Sheets

IMAGE FORMING APPARATUS WITH A FEEDING UNIT INCLUDING A PLURALITY OF RIBS

CROSS-REFERENCE TO RELATED APPLICATION

This application claims priority under 35 U.S.C. §119 from Japanese Patent Applications No. 2011-166691 filed on Jul. 29, 2011 and No. 2012-115276 filed on May 21, 2012. The entire subject matters of the applications are incorporated herein by reference.

BACKGROUND

1. Technical Field

The following description relates to one or more image forming apparatuses.

2. Related Art

An image forming apparatus has been known that includes an image forming unit configured to form an image on a sheet being conveyed, a turn-around mechanism configured to turn around a feeding direction of the sheet with the image formed on a first face thereof by the image forming unit, and a re-feeding unit configured to re-feed to the image forming unit the sheet turned around by the turn-around mechanism.

In addition, the re-feeding unit of the known image forming apparatus includes a first feeding route curved to turn the feeding direction of the sheet fed by the turn-around mechanism, toward the image forming unit, and a second feeding route configured to feed the sheet fed along the first feeding route, to an upstream side of the image forming unit in the feeding direction.

In the known image forming apparatus configured as above, when the sheet is re-fed by the re-feeding unit after the feeding direction of the sheet is turned around, one end in a width direction of the sheet has to be regulated to be placed in a predetermined position relative to the image forming unit. Therefore, the second feeding route includes a guide (a regulating member) for guiding the end of the sheet and a skew guide for introducing the sheet fed out of the first feeding route to the guide.

SUMMARY

However, in the known image forming apparatus, errors (e.g., dimension errors) resulting from manufacturing of the image forming unit and the turn-around mechanism might cause such a force as to pull the sheet, which is being conveyed, toward one end in the width direction. It might lead to a pressing force to press the skew guide and the guide (the regulating member). Thus, the pressing force might be likely to cause a problem such as buckling and a folded corner of the sheet.

Aspects of the present invention are advantageous to provide one or more improved techniques for an image forming apparatus that make it possible to prevent a problem such as buckling and a folded corner of a sheet from being caused when the sheet is re-fed.

According to aspects of the invention, an image forming apparatus is provided, which includes an image forming unit configured to form an image on a sheet being fed, a turn-around mechanism configured to turn around a feeding direction of the sheet with a first image formed on a first face thereof by the image forming unit, a re-feeding unit configured to re-feed, to the image forming unit, the sheet with the feeding direction thereof turned around by the turn-around mechanism, so as to allow the image forming unit to form a second image on a second face opposite to the first face of the sheet, the re-feeding unit including a first feeding unit that includes a guide curved to bulge in such a direction as to be farther from the image forming unit, the guide defining an outer side of a curved first feeding route configured to feed the sheet received from the turn-around mechanism downstream in the feeding direction, and a second feeding unit that defines a second feeding route configured to feed the sheet fed via the first feeding route to an upstream side of the image forming unit in the feeding direction, and the second feeding unit including a regulating member configured to define a first side of the second feeding route in a width direction perpendicular to the feeding direction of the sheet and regulate a position of an end of the sheet on the first side of the second feeding route in the width direction. The guide of the first feeding unit including a first section on the first side thereof in the width direction, and a second section on a second side opposite to the first side thereof in the width direction, the second section being curved to bulge more than the first section in such a direction as to be farther from the image forming unit.

According to aspects of the invention, further provided is an image forming apparatus, which includes an image forming unit configured to form an image on a sheet being fed, a turn-around mechanism configured to turn around a feeding direction of the sheet with a first image formed on a first face thereof by the image forming unit, a re-feeding unit configured to re-feed, to the image forming unit, the sheet with the feeding direction thereof turned around by the turn-around mechanism, so as to allow the image forming unit to form a second image on a second face opposite to the first face of the sheet, the re-feeding unit including a first feeding unit that includes a plurality of ribs extending along the feeding direction of the sheet received from the turn-around mechanism, the plurality of ribs being arranged along a width direction of the sheet, and formed in an arc shape curved to turn a feeding direction of the sheet, the plurality of ribs comprising distal end surfaces, a second feeding unit that includes a plurality of guide ribs extending along feeding direction of the sheet received from the first feeding unit, the plurality of guide ribs being arranged along a width direction of the sheet and formed to protrude toward the image forming unit, and a regulating member disposed on a first side of the re-feeding unit in a width direction perpendicular to the feeding direction of the sheet, the regulating member being configured to regulate a position of an end of the sheet on the first side in the width direction. The distal end surfaces include first distal end surfaces disposed at the first side thereof in the width direction, and a second distal end surfaces disposed at a second side opposite to the first side thereof in the width direction. Portions of the first distal end surfaces that are positionally coincident with a virtual plane parallel to an installation surface for installing the image forming apparatus thereon are closer to a center of the arc shape of the plurality of ribs than portions of the second distal end surfaces that are positionally coincident with the virtual plane.

BRIEF DESCRIPTION OF THE ACCOMPANYING DRAWINGS

DETAILED DESCRIPTION

It is noted that various connections are set forth between elements in the following description. It is noted that these connections in general and, unless specified otherwise, may be direct or indirect and that this specification is not intended to be limiting in this respect.

Hereinafter, an embodiment according to aspects of the present invention will be described with reference to the accompanying drawings.

(Embodiment)

Figure 1:
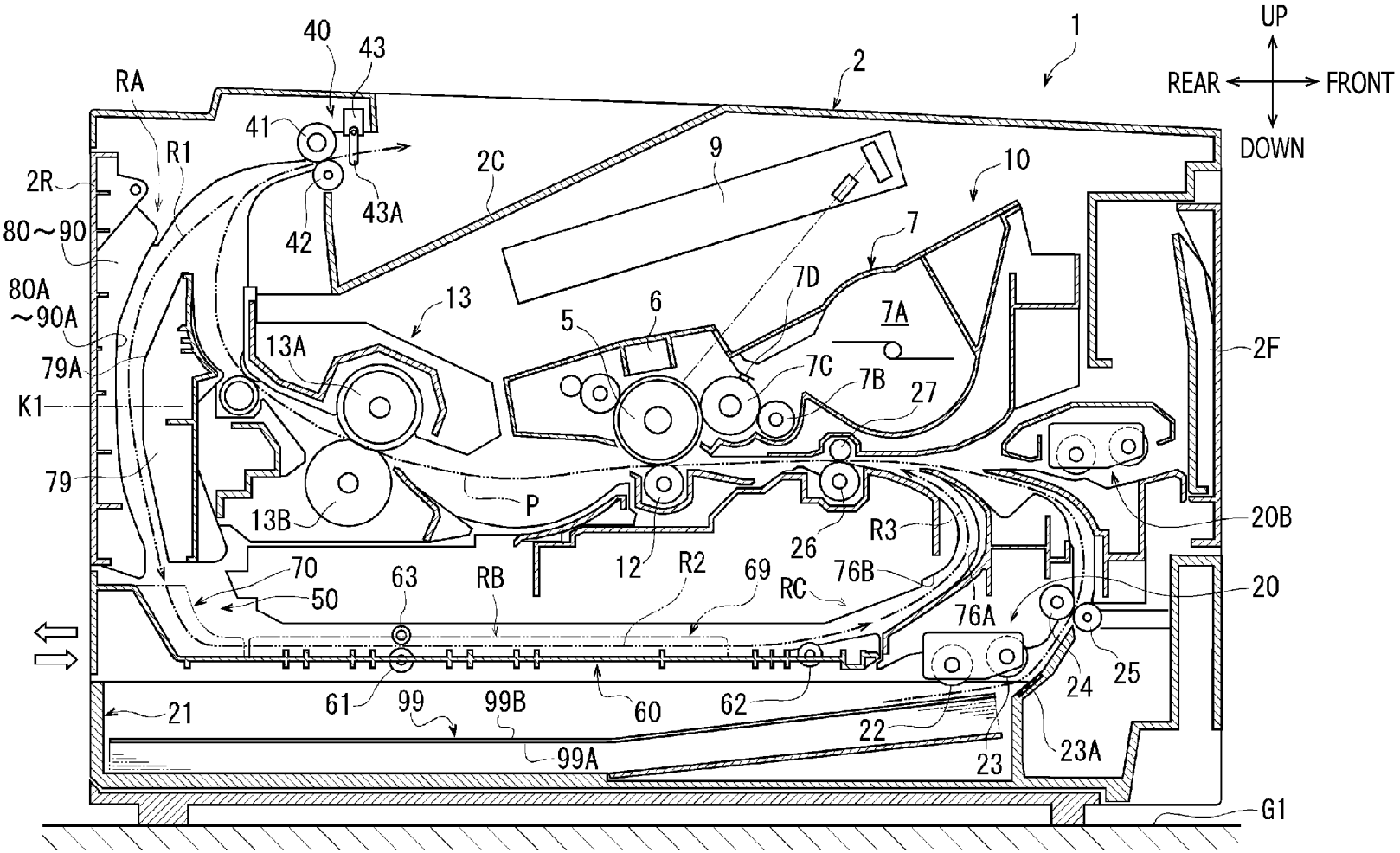
FIG. 1 is a cross-sectional side view schematically showing a printer in an embodiment according to one or more aspects of the present invention.

As shown in FIG. 1, a printer 1 in an embodiment according to aspects of the present invention is a monochrome laser printer configured to electrophotographically form a monochrome image on a sheet 99 (such as a paper and a transparency). It is noted that, in the following description, a front-to-rear direction, a left-to-right direction, and a vertical direction (upside-to-downside direction) of the printer 1 of the embodiment will be defined as shown in the accompanying drawings. Hereinafter, referring to FIG. 1, an explanation will be provided about each of elements included in the printer 1.

<Configuration Overview>

The printer 1 includes a substantially box-shaped housing 2 and a frame member (not shown) provided inside the housing 2. The housing 2 and the frame member form a main body of the printer 1. The main body is placed on a horizontal installation surface G1. To the frame member, various elements are attached that include a feeding unit 20, an image forming unit 10, ejection rollers 41 and 42 that double as a below-mentioned turn-around mechanism 40, and a re-feeding mechanism 50.

At a lower portion of the housing 2, a feed cassette 21 is provided, which has an upper side opened and is a substantially box-shaped body configured to accommodate one or more sheets 99. When pushed rearward from a front side of the printer 1, the feed cassette 21 is inserted into the housing 2 and attached to the main body. In addition, when pulled forward, the feed cassette 21 is drawn out of the main body. Moreover, the feed cassette 21 is configured to be entirely drawn and detached from the main body.

On an upper surface of the housing 2, a catch tray 2C is provided, which is configured to receive and hold a sheet 99 ejected after completion of image formation on the sheet 99. To a front face of the housing 2, a front cover 2F is attached in an openable and closable manner. Although the following state is not shown in any drawing, the front cover 2F is configured to, when opened forward, serve as a known manual feed tray. To a rear face of the housing 2, a rear cover 2R is attached in an openable and closable manner. When the rear cover 2R is opened rearward, a user is allowed to clear a paper jam or do maintenance for the printer 1. In the housing 2, there are provided a feeding path P, a first feeding route R1, a second feeding route R2, and a third feeding route R3.

The feeding path P is a pathway, which is formed substantially in an "S" shape when viewed along the left-to-right direction, extending from the feeding unit 20 disposed above a front end of the feed cassette 21 upward to the catch tray 2C via the image forming unit 10, and the ejection rollers 41 and 42. The first feeding route R1 is a pathway, which is formed substantially in a "C" shape when viewed along the left-to-right direction, extending downward from the ejection rollers 41 and 42 to be curved in a rearward-bulging manner. The second feeding route R2 is a pathway, which is disposed between the feeding cassette 21 and the image forming unit 10, extending forward substantially horizontally following the first feeding route R1. The third feeding route R3 is a pathway that extends forward following the second feeding route R2, turns around rearward substantially in a "U" shape, and joins an upstream point relative to the image forming unit 10 on the feeding path P. The first feeding route R1, the second feeding route R2, and the third feeding route R3 form the re-feeding mechanism 50 for re-feeding to the image forming unit 10 a sheet 99 with one or more images formed thereon by the image forming unit 10. The first feeding route R1 and a part of the feeding path P that extends from a fixing unit 13 to the ejection rollers 41 and 42 use in common (share) a portion around the ejection rollers 41 and 42. A feeding guide member 79 separates a portion of the feeding path P closer to the fixing unit 13 than the common portion, from a portion of the first feeding route R1 closer to the second feeding route R2 than the common portion.

<Feeding Unit>

The feeding unit 20 includes a feed roller 22, a separation roller 23, a separation pad 23A, feed rollers 24 and 25, and registration rollers 26 and 27. The feeding unit 20 is configured to feed the sheets 99 placed in the feed cassette 21 to the feeding path P on a sheet-by-sheet basis by the feed roller 22, the separation roller 23, and the separation pad 23A. Further, the feeding unit 20 is configured to feed the sheets 99 toward the image forming unit 10 by the feed rollers 24 and 25 and the registration rollers 26 and 27 that are disposed on a substantially U-shaped section of the feeding path P for turning around the sheets 99 rearward.

<Image Forming Unit>

The image forming unit 10 includes a process cartridge 7, a transfer roller 12, a scanning unit 9, and the fixing unit 13.

The process cartridge 7 includes a photoconductive drum 5 disposed above a substantially horizontal section extending rearward from the front side on the feeding path P. The photoconductive drum 5 includes a positively chargeable photoconductive layer formed on an uppermost layer of a cylindrical resin body. Above the photoconductive drum 5, a known electrification device 6 is disposed to face the photoconductive layer of the photoconductive drum 5.

Further, the process cartridge 7 includes a development roller 7C disposed to face the photoconductive drum 5 from the front side, a toner container 7A disposed ahead of the development roller 7C, and a supply roller 7B disposed between the development roller 7C and the toner container 7A to face the development roller 7C. The toner stored in the toner container 7A is supplied to the development roller 7C by rotation of the supply roller 7B, and carried on the surface of the development roller 7C. Then, after adjusted by a layer thickness regulating blade 7D to have a predetermined thickness, the toner is supplied to the surface of the photoconductive drum 5.

The scanning unit 9 is disposed in an uppermost region inside the housing 2. The scanning unit 9 includes a laser light source, a polygon mirror, an f0 lens, and a reflecting mirror. A laser beam emitted by the laser light source is deflected by a polygon mirror, transmitted through the fθ lens, reflected and directed downward by the mirror, and then rendered incident onto the surface of the photoconductive drum 5 to form an electrostatic latent image.

The transfer roller 12 is disposed to face the photoconductive drum 5 from beneath across the feeding path P. The transfer roller 12 is configured to rotate in synchronization with the photoconductive drum 5 in a state negatively charged by a transfer voltage applied.

The fixing unit 13 is disposed behind the image forming unit 10 and includes a heating roller 13A and a pressing roller 13B facing each other across the feeding path P in the vertical direction. The heating roller 13A is configured to heat the toner transferred onto the sheet 99 and rotate while being pressed by the pressing roller 13B. Thereby, the fixing unit 13 heats and melts the toner transferred onto the sheet 99 to fix the toner onto the sheet 99, and then feeds the sheet 99 to a downstream side on the feeding path P. It is noted that the feeding path P extends upward to be curved substantially in a "U" shape at a downstream side relative to the fixing unit 13. At a most downstream end of the feeding path P, there are provided the ejection rollers 41 and 42, an ejection sensor 43, and the catch tray 2C. The ejection rollers 41 and 42 and the ejection sensor 43 double as the below-mentioned turn-around mechanism 40.

<Overview of Image Forming Operation>

When image formation is performed on a first side 99A of a sheet 99, a controller (not shown) begins to control the feeding unit 20 and the image forming unit 10. Specifically, the controller controls the feeding unit 20 to feed the sheet 99 placed in the feed cassette 21, and controls the scanning unit 9 and the process cartridge 7 to perform an image forming operation. Thereby, after evenly and positively charged by the electrification device 6, the surface of the rotating photoconductive drum 5 is exposed to the laser beam emitted by the scanning unit 9 to have an electrostatic latent image formed thereon based on image formation data.

Meanwhile, the positively charged toner carried on the development roller 7C is supplied to the electrostatic latent image formed on the surface of the photoconductive drum 5 in response to the development roller 7C rotating in contact with the photoconductive drum 5. Thereby, the electrostatic latent image on the photoconductive drum 5 is rendered visible such that a toner image formed by a reversal phenomenon is carried on the photoconductive drum 5.

When the sheet 99 is placed in the feed cassette 21, the first side 99A of the sheet 99 faces downward. Then, when the sheet 99 is conveyed along the feeding path P to pass through the image forming unit 10, the first side 99A faces the photoconductive drum 5 in an upward-facing state.

The toner image carried on the surface of the photoconductive drum 5 is transferred onto the first side 99A of the sheet 99 by the transfer voltage applied to the transfer roller 12. Then, when conveyed to the fixing unit 13, the sheet 99 is heated and pressed by the heating roller 13A and the pressing roller 13B, such that the toner image is fixed onto the first side 99A of the sheet 99. Finally, the sheet 99 with the image formed thereon is ejected onto the catch tray 2C by the ejection rollers 41 and 42, and the image forming operation is completed.

Further, although a detailed explanation about it will be omitted, the printer 1 is configured to perform the aforementioned image forming operation on a sheet that is manually fed inward from the front side of the maim body in a state where the front cover 2F is opened and further fed onto the feeding path P by a known manual feeding unit 20B.

Further, as will be described in detail, the printer 1 is configured to, after performing the image forming operation on the first side 99A of the sheet 99, re-feed the sheet 99 to the image forming unit 10 by the turn-around mechanism 40 and the re-feeding mechanism 50 and perform the image forming operation on a second side 99B.

<Turn-Around Mechanism>

The turn-around mechanism 40 is configured to turn around the feeding direction of the sheet 99 with the image formed on the first side 99A. The turn-around mechanism 40 includes the ejections rollers 41 and 42, and the ejection sensor 43.

The ejection roller 41 is controlled by the controller (not shown) to rotate in an intended direction switchable between a normal direction and a reverse direction. Meanwhile, the ejection roller 42 is driven (by rotation of the ejection roller 41) to rotate while pressing the sheet 99 against the ejection roller 41.

The ejection sensor 43 is disposed in a position closer to the catch tray 2C than the ejection rollers 41 and 42. The ejection sensor 43 is a known sensor configured to detect a displacement of an actuator 43A swingable in contact with the sheet 99 with an optical sensing device such as a photo-interrupter.

<Operations of Turn-Around Mechanism>

The turn-around mechanism 40 is configured to turn around the feeding direction of the sheet 99 with the image formed on the first side 99A in accordance with the following procedure. When conveyed along the feeding path P and passing through the image forming unit 10, the sheet 99 is introduced by the feeding guide member 79 toward the ejection rollers 41 and 42 and then nipped between and fed by the ejection rollers 41 and 42 toward the catch tray 2C. Thereby, the sheet 99 pushes the actuator 43A to be swung, and the ejection sensor 43 provides the controller with information on detection of the sheet 99. Then, while measuring time, the controller switches the rotational direction of the ejection roller 41 to the reverse direction at a moment when the trailing end of the sheet 99 has passed through the feeding guide member 79. At this time, the sheet 99 gets out of the feeding guide member 79 and becomes less curled by stiffness of the sheet 99 such that the trailing end of the sheet 99 is directed toward the first feeding route R1. Consequently, the sheet 99 is fed along the first feeding route R1 by the ejection roller 41 reversely rotating. At this time, the sheet 99 is conveyed while being curled in a rearward-bulging manner with the second side 99B thereof facing rearward.

<Re-Feeding Mechanism>

The re-feeding mechanism 50 includes the first feeding unit RA, the second feeding unit RB, and the third feeding unit RC. The re-feeding mechanism 50 is configured to re-feed to the image forming unit 10 the sheet 99 of which the feeding direction is turned around by the turn-around mechanism 40.

The first feeding unit RA includes eleven ribs 80, 81, 82, 83, 84, 85, 86, 87, 88, 89, and 90 formed on the rear cover 2R, and a feeding surface 79A of the feeding guide member 79 that faces the ribs 80 to 90 across a gap from the front side. The ribs 80 to 90 and the feeding surface 79A form the first feeding route R1 therebetween. The second feeding unit RB includes a re-feeding tray 60 disposed between the image forming unit 10 and the feed cassette 21 in the vertical direction. Further, the second feeding unit RB includes the second feeding route R2 on an upper surface of the re-feeding tray 60. The third feeding unit RC is configured using a frame member disposed between the re-feeding tray 60 and the process cartridge 7. The third feeding unit RC includes the third feeding route R3 that runs up and down to penetrate a frame member disposed ahead of the re-feeding tray 60. The third feeding route R3 is curved to bulge forward, and the front and rear sides thereof are defined by return feeding surfaces 76A and 76B, respectively.

Figure 2:
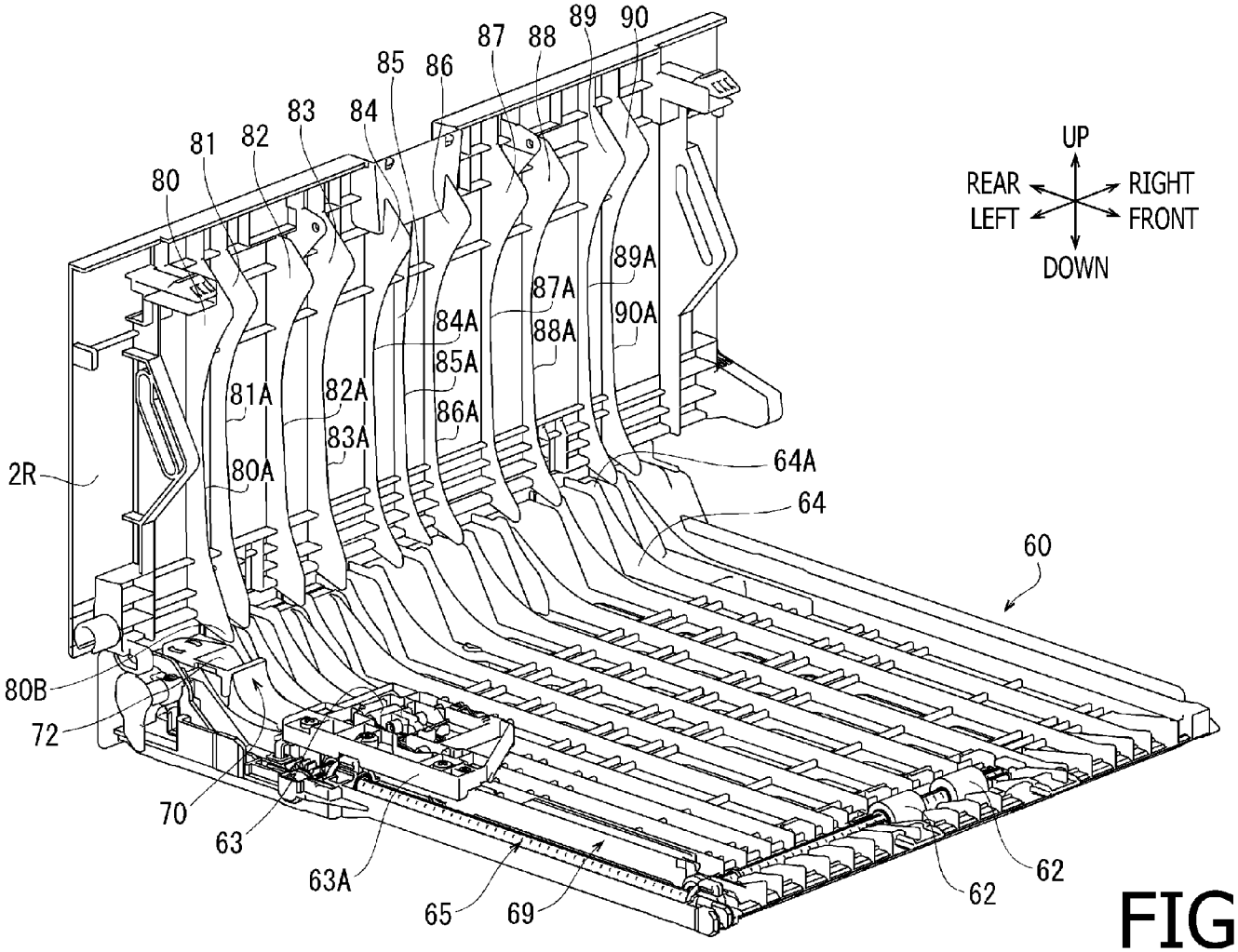
FIG. 2 is a perspective view showing a relative-position relationship between a rear cover and a re-feeding tray of the printer in the embodiment according to one or more aspects of the present invention.
Figure 3:
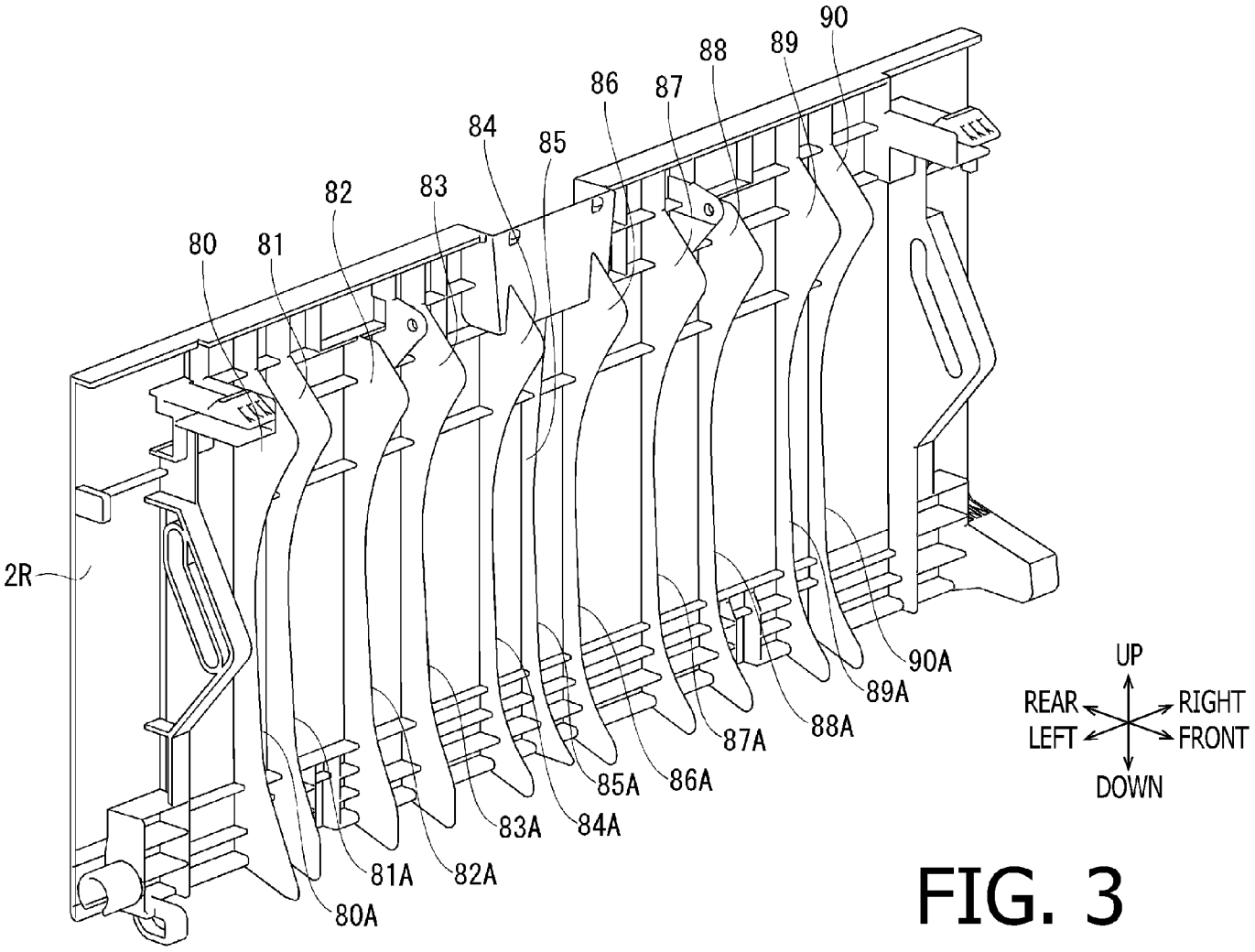
FIG. 3 is a perspective view showing the rear cover with ribs formed thereof in the embodiment according to one or more aspects of the present invention.

As shown in FIGS. 2 and 3, the ribs 80 to 90 are formed integrally with the rear cover 2R to protrude forward from an inner wall surface of the rear cover 2R, as flat plates that are disposed to be apart from and parallel to each other in the left-to-right direction and elongated along the vertical direction. In other words, the ribs 80 to 90 are disposed in such respective positions as to face the second side 99B of the sheet 99 being fed along the first feeding route R1 at an outer side (a rear side) of a curved section of the first feeding route R1 (i.e., at a farther side of the curved section from a center of an arc of the curved section). Namely, distal end surfaces (i.e., front end surfaces) of the ribs 80 to 90 form a guide surface for the first feeding route R1. A detailed explanation will be provided later about shapes of the ribs 80 to 90.

Figure 4:
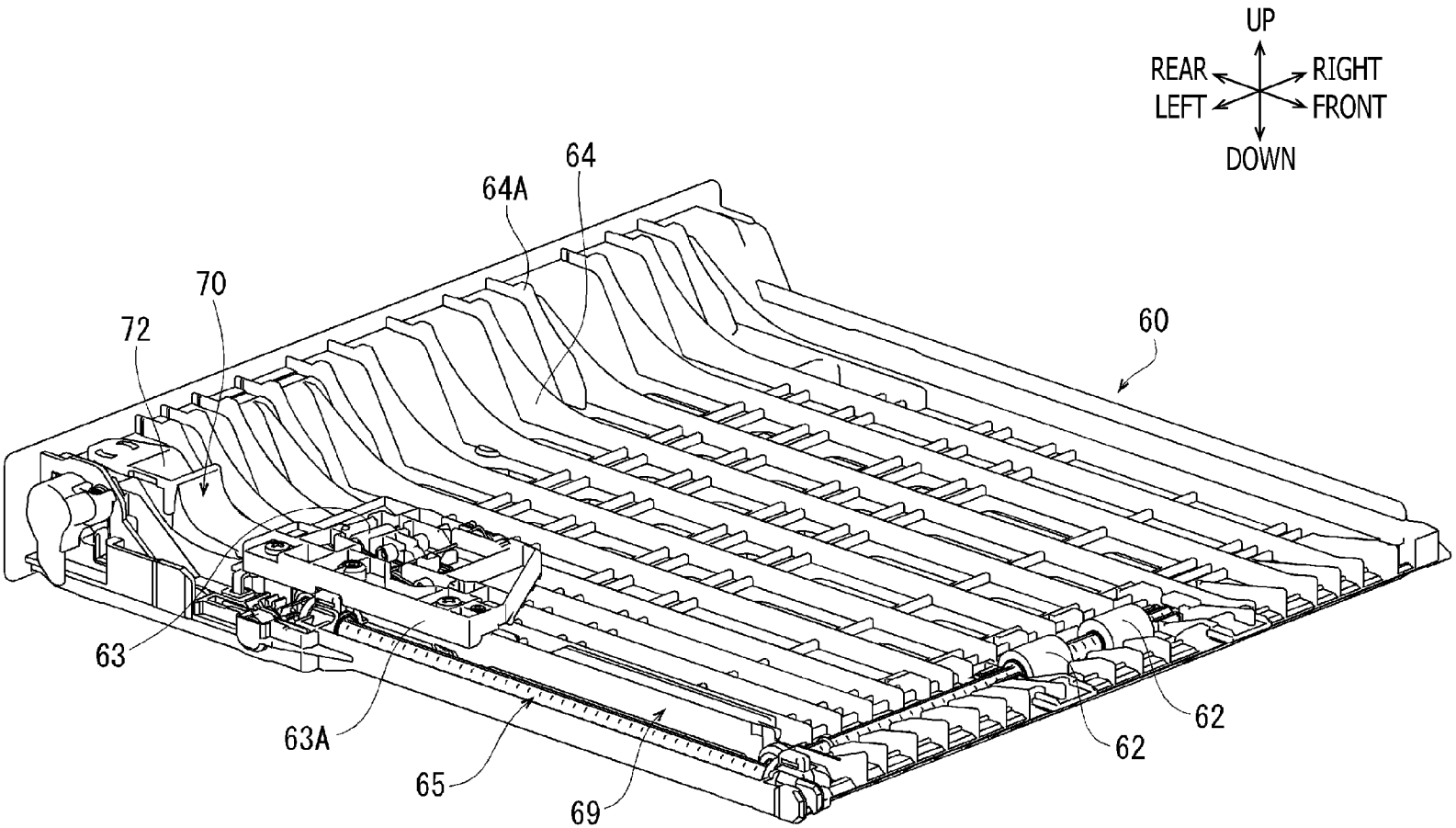
FIG. 4 is a perspective view of the re-feeding tray in the embodiment according to one or more aspects of the present invention.

As shown in FIG. 1, the re-feeding tray 60 is formed substantially in a shape of a flat plate extending substantially in parallel with a part of the feeding path P that runs through the image forming unit 10. On the upper surface of the re-feeding tray 60, as shown in FIGS. 2 and 4, there are provided a plurality of ribs 64 that extend along the front-to-rear direction and protrude from the upper surface of the re-feeding tray 60 so as to be substantially parallel to each other in the left-to-right direction. A rear end 64A (i.e., an end on a side of the first feeding route R1) of each rib 64 protrudes upward up to such a position as to overlap lower ends of the ribs 80 to 90 when viewed along the left-to-right direction. Distal end surfaces (i.e., upper end surfaces) of the ribs 64 form a guide surface for the second feeding route R2.

There is a regulating member 69 provided at a left side of the re-feeding tray 60. The regulating member 69 is formed in a shape of a partition extending along the feeding direction (in this case, the front-to-rear direction) of the sheet 99 to be fed on the second feeding route R2. The regulating member 69 includes a substantially linear reference surface 69A (see FIG. 6) perpendicular to a sheet width direction. The reference surface 69A defines the position of a left end of the second feeding route R2. On the re-feeding tray 60, there is a guide member 70 disposed at a joint portion between the first feeding route R1 and the second feeding route R2, behind the reference surface 69A (i.e., at a side of the first feeding route R1). When a left end 99L of the sheet 99 contacts the reference surface 69A without being oblique with respect to the reference surface 69A, the sheet 99 is put into a state where the sheet 99 is positioned correctly for the image forming unit 10 to perform image formation on the second side 99B of the sheet 99, in the left-to-right direction without any skew angle. It is noted that a below-mentioned first regulating surface 71 of the guide member 70 may be formed to be continuous with the reference surface 69A as a part of the regulating member 69.

Figure 5:
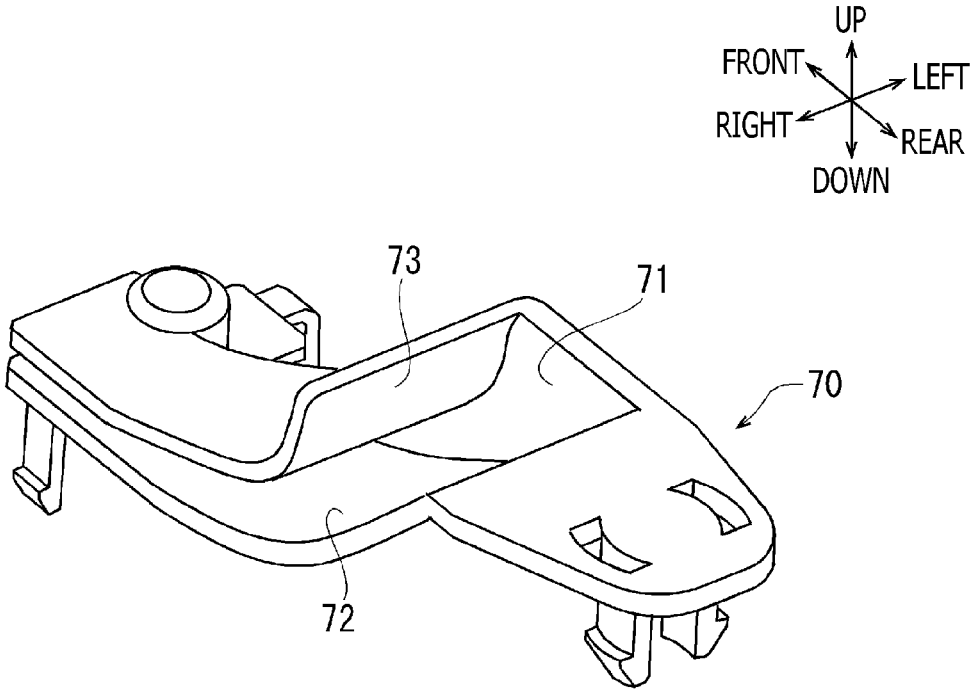
FIG. 5 is a perspective view of a guide member of the printer in the embodiment according to one or more aspects of the present invention.

As shown in FIG. 5, the guide member 70 includes a first regulating surface 71, a second regulating surface 72, and a third regulating surface 73. The first regulating surface 71 has a front end formed as a flat surface continuous with the reference surface 69A and a rear end extending in a slanted manner to be leftward farther from the reference surface 69A. The second regulating surface 72 is curved so as to be substantially positionally coincident with an upper end face of the upward-protruding rear end 64A of each rib 64 when viewed along the left-to-right direction. The third regulating surface 73 is curved while extending rearward and upward so as to be farther from the second regulating surface 72 across the second feeding route R2 in positions opposed to the second regulating surface 72 when viewed along the left-to-right direction. A gap between the front end (i.e., the end on the side of the regulating member 69) of the third regulating surface 73 and the front end of the second regulating surface 72 is smaller than a gap between the rear end (i.e., the end on the side of the first feeding route R1) of the third regulating surface 73 and the rear end of the second regulating surface 72. The second regulating surface 72 and the third regulating surface 73 extend inward in a width direction of the second feeding route R2 from the first regulating surface 71, and are integrally formed substantially in a rectangular "C" shape when viewed from the front side. The guide member 70 is fixed onto the re-feeding tray 60.

Further, on the re-feeding tray 60, feed rollers 61 and 62 and a driven roller 63 are provided.

Figure 6:
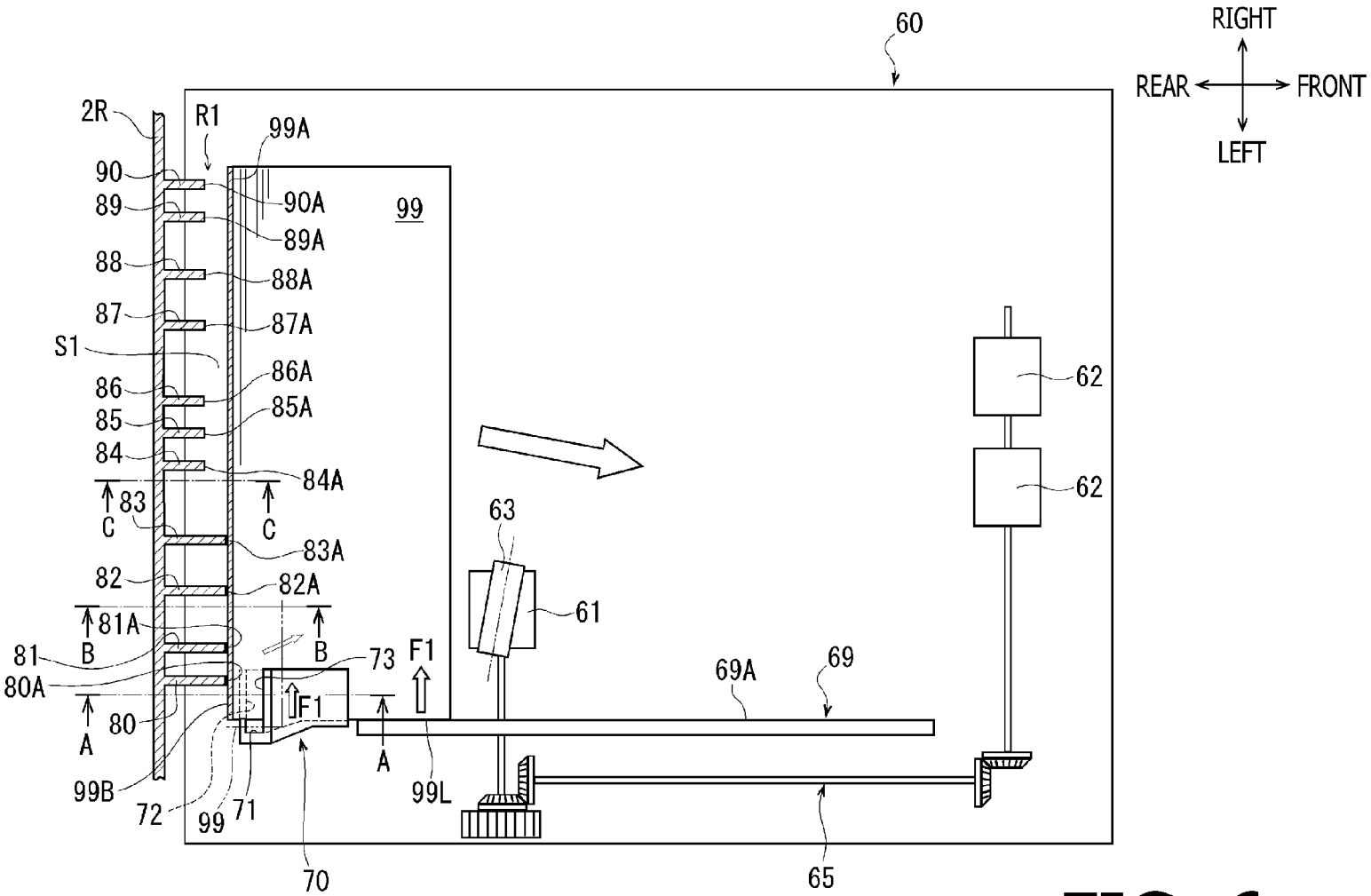
FIG. 6 is a cross-sectional top view schematically showing a relative-position relationship among a sheet, the ribs, the guide member, a regulating member, a driven roller in the embodiment according to one or more aspects of the present invention.

As shown in FIG. 6, the feed roller 6 is disposed on a right side of the reference surface 69A. The feed rollers 62 are disposed ahead away from the reference surface 69A in the feeding direction. Each of the feed rollers 61 and 62 slightly protrudes upward from the upper surfaces of the ribs 64, so as to contact the downward-facing second side 99B of the sheet 99 to be conveyed on the second feeding route R2. Each of the feed rollers 61 and 62 is rotated around a rotational axis extending along the left-to-right direction by a driving force that is transmitted from a driving source via a transmission mechanism 65. The transmission mechanism 65 includes a plurality of gears, a transmission shaft, and a rotational shaft.

The driven roller 63 is disposed above the feed roller 61. At a left side of the re-feeding tray 60, a supporting member 63A is disposed to be higher than and separated from the feed roller 61 and the ribs 64 across the second feeding route R2. The driven roller 63 is rotatably supported by the supporting member 63A. Further, the driven roller 63 is pressed by an urging spring (not shown) against the feed roller 61. A rotational axis of the driven roller 63 is slanted clockwise with respect to a rotational axis of the feed roller 61 when viewed from the top (the upper side).

In response to rotation of the feed rollers 61 and 62, the sheet 99 is fed along the second feeding route R2. At this time, when the driven roller 63 is pressed against the feed roller 61 via the sheet 99 and thereby driven to rotate, the sheet 99 is conveyed while being pulled leftward, i.e., toward the reference surface 69A.

When pulled backward out of the rear face of the printer 1, the re-feeding tray 60 and the guide member 70 are detached from the main body of the printer 1. Meanwhile, when inserted from the rear face of the printer 1 and pushed forward, the re-feeding tray 60 and the guide member 70 are attached to the main body of the printer 1. At this time, the transmission mechanism 65 shown in FIG. 6 is separated from the driving source (not shown) provided at the side of the main body and detached together with the re-feeding tray 60 from the main body.

The return feeding surfaces 76A and 76B, which form the third feeding route R3, are respectively a front surface and a rear surface of a through path that runs up and down to penetrate the frame member between the re-feeding tray 60 and the process cartridge 70 ahead of the image forming unit 10 and the re-feeding tray 60. The return feeding surfaces 76A and 76B extend upward from downside to be curved in a forward-bulging manner. By the third feeding route R3 between the return feeding surfaces 76A and 76B, the sheet 99 is guided upward to the image forming unit 10 from the re-feeding tray 60.

<Shapes of Ribs>

The ribs 80 to 90 that form the first feeding route R1 will be described. The ribs 80 to 90 include distal end surfaces 80A, 81A, 82A, 83A, 84A, 85A, 86A, 87A, 88A, 89A, and 90A, respectively, each of which is configured to extend in the upward vertical direction as the feeding direction of the sheet 99 and contact the second side 99A of the sheet 99 to be fed in the feeding direction. Each of the distal end surfaces 80A to 90A is formed to be concaved rearward at a middle portion thereof in the vertical direction when viewed along the left-to-right direction. Thus, the distal end surfaces 80A to 90A are configured to turn the feeding direction of the sheet 99, which is being fed on the first feeding route R1 while making the sheet 99 curve, forward (i.e., toward the second feeding route R2).

The ribs 80 to 90 are divided into two groups, i.e., a first group that includes the ribs 80 to 83 disposed closer to the reference surface 69A of the second feeding route R2 in the left-to-right direction, and a second group that includes the other ribs 84 to 90 disposed farther from the reference surface 69A of the second feeding route R2 in the left-to-right direction. As shown in FIG. 6 (which is a cross-sectional top view of the main body of the printer 1 along a virtual plane K1 parallel to the installation surface G1), in the middle portions (i.e., the rearward-concaved portions) in the vertical direction of the distal end surfaces 80A to 90A of the ribs 80 to 90, the distal end surfaces 80A to 83A of the ribs 80 to 83 included in the first group are disposed ahead of the distal end surfaces 84A to 90A of the ribs 84 to 90 included in the second group (i.e., the portions of the distal end surfaces 80A to 83A of the ribs 80 to 83 included in the first group are disposed to be closer to the center of the arc of the curved section of the first feeding route R1 than the portions of the distal end surfaces 84A to 90A of the ribs 84 to 90 included in the second group). In other words, the forward-protruding length of the ribs 80 to 83 from the rear cover 2R to the distal end surfaces 80A to 83A is longer than that of the ribs 84 to 90 from the rear cover 2R to the distal end surfaces 84A to 90A. It is noted that the width of the second group including the ribs 84 to 90 in the sheet width direction is larger than the width of the first group including the ribs 80 to 83 in the sheet width direction.

Figures 7A, 7B, 7C:
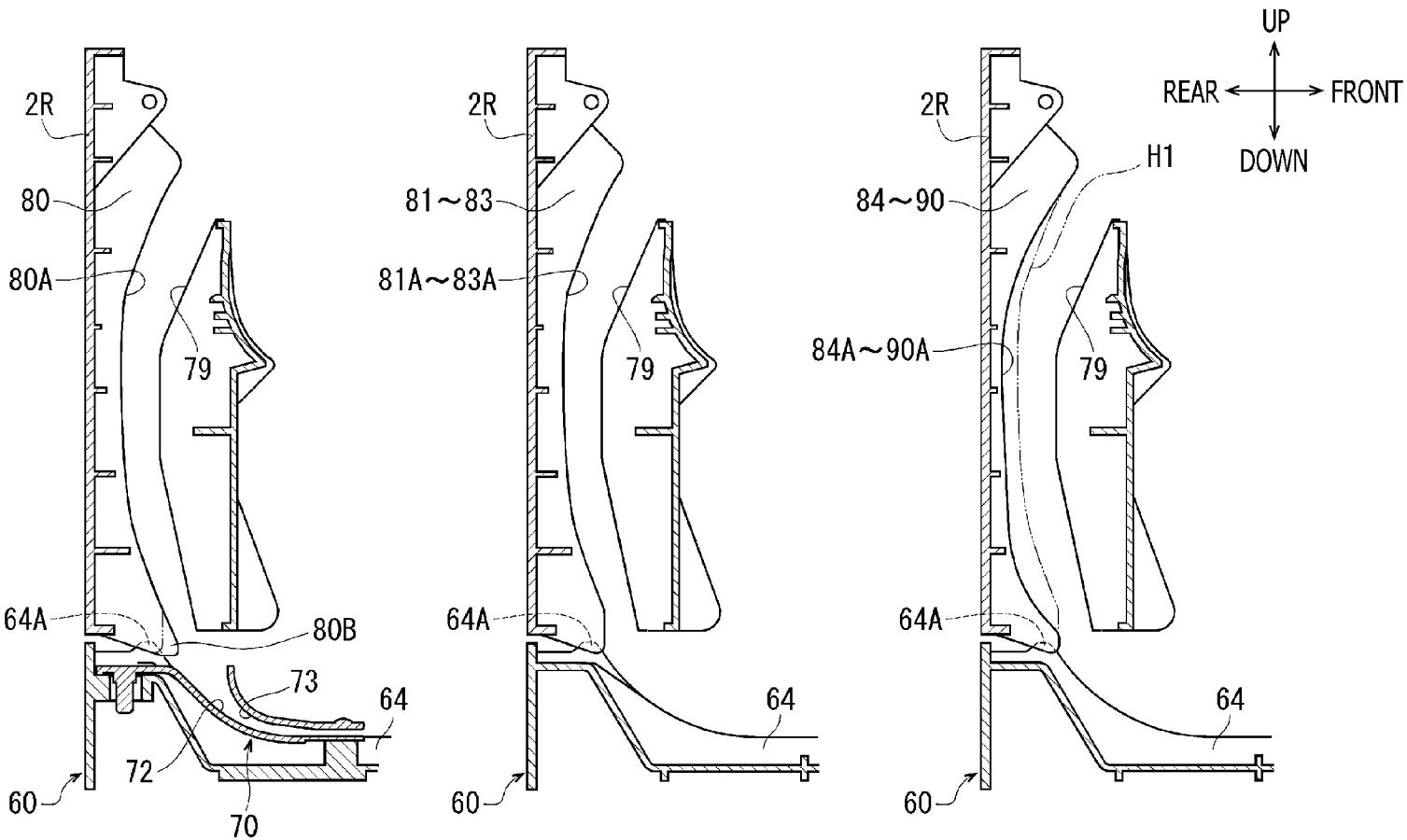
FIG. 7A is a cross-sectional side view schematically showing a configuration around a first feeding route along an A-A plane shown in FIG. 6 in the embodiment according to one or more aspects of the present invention.
FIG. 7B is a cross-sectional side view schematically showing a configuration around the first feeding route along a B-B plane shown in FIG. 6 in the embodiment according to one or more aspects of the present invention.
FIG. 7C is a cross-sectional side view schematically showing a configuration around the first feeding route along a C-C plane shown in FIG. 6 in the embodiment according to one or more aspects of the present invention.

In the embodiment, as clearly shown in FIGS. 7A (indicating the rib 80), 7B (indicating the ribs 81 to 83), and 7C (indicating the ribs 84 to 90), the distal end surfaces 80A to 90A of the ribs 80 to 90 are formed such that the rearward-concaved middle portions thereof in the vertical direction have different concave amounts between the first group and the second group. However, at the upper end (the end on the side of the turn-around mechanism 40) and the lower end (the end on the side of the second feeding route R2) of each rib 80 to 90, the ribs 80 to 90 curve to be closer to the second feeding route R2 and are substantially positionally coincident with each other when viewed along the left-to-right direction (i.e., the sheet width direction). Thus, it allows the sheet 99 to be smoothly conveyed from the turn-around mechanism 40 to the first feeding route R1 and from the first feeding route R1 to the second feeding route R2.

The lower end of each rib 80 to 90 extends to such a position as to overlap the rear ends 64A of the ribs 64 when viewed along the left-to-right direction. Thereby, it is possible to prevent the sheet 99 from getting stuck on the rear ends 64A of the ribs 64. Further, as shown in FIG. 7A, the lower end 80B of the leftmost rib 80 extends slightly ahead of the ribs 81 to 83 and protrudes ahead of the second regulating surface 72 of the guide member 70. Thus, it is possible to prevent the sheet 99 from getting stuck on the second regulating surface 72.

The feeding surface 79A is formed on a rear surface of the feeding guide member 79, to be ahead away from the ribs 80 to 90 across the first feeding route R1. In other words, the feeding surface 79A is disposed in such a position as to face the first side 99A of the sheet 99 being fed along the first feeding route R1 at an inner side (a front side) of the curved section of the first feeding route R1. The feeding surface 79A extends downward along a direction in which the sheet 99 is fed on the first feeding route R1, so as to be curved in a rearward-bulging manner. The feeding surface 79A and the ribs 80 to 90 form the first feeding route R1, and thus it allows the sheet 99 to be certainly guided along the first feeding route R1.

<Operations of Re-Feeding Unit>

The sheet 99 turned around by the turn-around mechanism 40 is fed by the ejection roller 41 while being curled along the first feeding route R1, and then introduced onto the second feeding route R2.

The sheet 99 introduced onto the second feeding route R2 is directed forward in the horizontal direction while contacting the second regulating surface 72 of the guide member 70 and the upward-protruding rear ends 64A. At this time, the left side of the sheet 99 is smoothly introduced into the guide member 70 by the distal end surfaces 80A to 83A of the ribs 80 to 83. Further, even though the sheet 99 floats off the distal end surfaces 80A to 90A of the ribs 80 to 90 on the first feeding route R1 or floats off the second regulating surface 72, the sheet 99 is allowed to be smoothly guided by the feeding surface 79A and the third regulating surface 73 contacting the first side 99A of the sheet 99.

Errors (e.g., dimension errors) resulting from manufacturing of elements or components (such as the fixing unit 13, the rollers 41 and 42 of the turn-around mechanism 40, and surfaces forming the feeding path P or the first feeding route R1) might cause the sheet 99 to skew leftward or be fed in a state undesirably close to one end (the left end) in the sheet width direction. In such a case, as indicated by a long dashed double-short dashed line in FIG. 6, when a left corner of the sheet 99 contacts the first regulating surface 71, the sheet 99 is guided rightward along the first regulating surface 71.

The left corner of the sheet 99 is pressed against the first regulating surface 71, and the sheet 99 is conveyed while receiving a pressing force F1 (see FIG. 6) as a reaction force of the pressing of the left corner of the sheet 99 against the first regulating surface 71. Hence, the pressing force F1 might cause a problem such as buckling and a folded corner of the sheet 99. This is because the sheet 99 is curled by the first feeding route R1, the second feeding route R2, and the upward-protruding rear end 64A of each rib 64 and pressed against surfaces of thereof, and thereby a large resistance of the sheet 99 in the direction of the pressing force F1 might lead to the aforementioned problem such buckling and a folded corner of the sheet 99. However, the right-side distal end surfaces 84A to 90A are disposed at a further outer side of the curved section of the first feeding route R1 than the left-side distal end surfaces 80A to 83A, and therefore there is a space S1 (see FIG. 6) secured on the right side of the first feeding route R1. Thereby, even though the pressing force F1 is applied to the sheet 99, the sheet 99 is allowed to have a smaller resistance in the space S1, easily move in the sheet width direction (the direction of the pressing force F1), and easily curl in the space S1. Therefore, the sheet 99 is conveyed to a position along the reference surface 69A while moving in the sheet width direction along the first regulating surface 71. Thus, it is possible to prevent the aforementioned problem such as buckling and a folded corner of the sheet 99. At this time, the left side of the sheet 99 is smoothly guided to the reference surface 69A by the distal end surfaces 80A to 83A of the ribs 80 to 83 without being so largely bent. It is noted that when the sheet 99 fed out of the first feeding route R1 skews in such a direction as to directly contact the reference surface 69A without the left corner of the sheet 99 contacting the first regulating surface 71.

The sheet 99 introduced onto the second feeding route R2 changes its state from a curled state to a flattened state, and is fed forward along the second feeding route R2. Then, the sheet 99 is pinched between and fed by the feed roller 61 and the driven roller 63. At this time, the sheet 99 is pulled leftward by the feeding rollers 61 and 62 and the driven roller 63, and the left end 99L of the sheet 99 is pressed against the reference surface 69A. Consequently, a skew correction is made for the sheet 99, and the sheet 99 is positioned in the left-to-right direction.

Thereafter, the sheet 99 passes through the third feeding route R3, returns onto the feeding path P, and is again fed to the image forming unit 10. Thus, the sheet 99 is opposed to the photoconductive drum 5 with the second side 99B thereof facing upward, such that the image forming operation is performed on the second side 99B.

<Operations and Effects>

In the printer 1 of the embodiment, the left end 99L of the sheet 99 is pressed against the regulating member 69 and the sheet 99 is positioned. When the sheet 99 which is being fed out of the first feeding route R1 is in a position closer to the left side of the first feeding route R1 than to the right side thereof, the pressing force F1 acts on the sheet 99 as a reaction force applied in response to contact between the sheet 99 and the first regulating surface 71. When there is no countermeasure provided for the pressing force F1, a problem such as buckling and a folded corner of the sheet 99 might be likely to be caused, e.g., at a curled portion of the sheet 99.

In this respect, according to the printer 1 of the embodiment, the left-side distal end surfaces 80A to 83A closer to the reference surface 69A are disposed at a further inner side of the first feeding route R1 than the right-side distal end surfaces 84A to 90A farther from the reference surface 69A. Therefore, it is possible to secure the space S1 on the right side of the first feeding route R1. Thus, even though the pressing force F1 acts on the sheet 99 in response to the left corner of the sheet 99 contacting the first regulating surface 71, the sheet 99 is allowed to easily move rightward and curl in the space S1. Accordingly, it is possible to feed the sheet 99 in a position along the reference surface 69A while preventing a problem such as buckling and a folded corner of the sheet 99.

Further, when the left corner of the sheet 99 fed out of the first feeding route R1 directly contacts the reference surface 69A, the sheet 99 is allowed to easily move in the sheet width direction and therefore conveyed along the reference surface 69A without undergoing a problem such as buckling and a folded corner of the sheet 99.

Furthermore, according to the printer 1 of the embodiment, when introduced from the first feeding route R1 onto the second feeding route R2, the sheet 99 is guided while being pinched between the second regulating surface 72 and the third regulating surface 73 of the guide member 70. Therefore, it is possible to certainly turn the feeding direction of the sheet 99. Consequently, it is possible to further certainly prevent a problem such as buckling and a folded corner of the sheet 99 during the re-feeding operation.

Moreover, according to the printer 1 of the embodiment, the second regulating surface 72 regulates the sheet 99 earlier than the first regulating surface 71. Thereby, after the feeding direction of the sheet 99 is turned to be along the second feeding route R2, the sheet 99 is regulated in the width direction. Thus, it is possible to certainly prevent buckling of the sheet 99.

Further, according to the printer 1 of the embodiment, the ribs 84 to 90 included in the second group are disposed within a wider range in the width direction of the sheet 99 than the ribs 80 to 83 included in the first group. In addition, the ribs 84 to 90 included in the second group are curved to bulge further outward than the ribs 80 to 83 included in the first group. Therefore, it is possible to secure the space S1 at the right side of the first feeding route R1, which is wider than a space secured at the left side of the first feeding route R1. Thus, it is possible to move the sheet 99 rightward such that the sheet 99 easily curls in the space S1.

Further, according to the printer 1 of the embodiment, the ribs 80 to 90 that form the first feeding route R1 are formed separately from the re-feeding tray 60 that forms the second feeding route R2. Therefore, it is possible to form the ribs 80 to 90, which have different heights (forward-protruding lengths) from the rear cover 2R to the distal end surfaces 80A to 90A, in a more simplified manufacturing process than when the first feeding route R1 is formed integrally with the second feeding route R2.

Further, according to the printer 1 of the embodiment, the rear cover 2R that includes the ribs 80 to 90 forming the first feeding route R1 is configured to be opened and closed, and the re-feeding tray 60 and the guide member 70 that form the second feeding route R2 are configured to be detached from the main body of the printer 1. Therefore, it is possible to easily clear the sheet 99 jamming on the first feeding route R1 and/or the second feeding route R2.

Further, according to the printer 1 of the embodiment, the first feeding route R1 is provided behind the main body of the printer 1. In addition, the second feeding route R2 is configured to feed the sheet 99 fed along the first feeding route R1, toward the front side of the main body. Thereby, the aforementioned operations and effects are certainly provided.

Hereinabove, the embodiment according to aspects of the present invention has been described. The disclosure can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the disclosure. However, it should be recognized that the disclosure can be practiced without reapportioning to the details specifically set forth. In other instances, well known processing structures have not been described in detail, in order not to unnecessarily obscure the disclosure.

Only an exemplary embodiment of the disclosure and but a few examples of their versatility are shown and described in the disclosure. It is to be understood that the disclosure is capable of use in various other combinations and environments and is capable of changes or modifications within the scope of the inventive concept as expressed herein. For example, the following modifications are possible.

(Modifications)

Figures 8A, 8B:
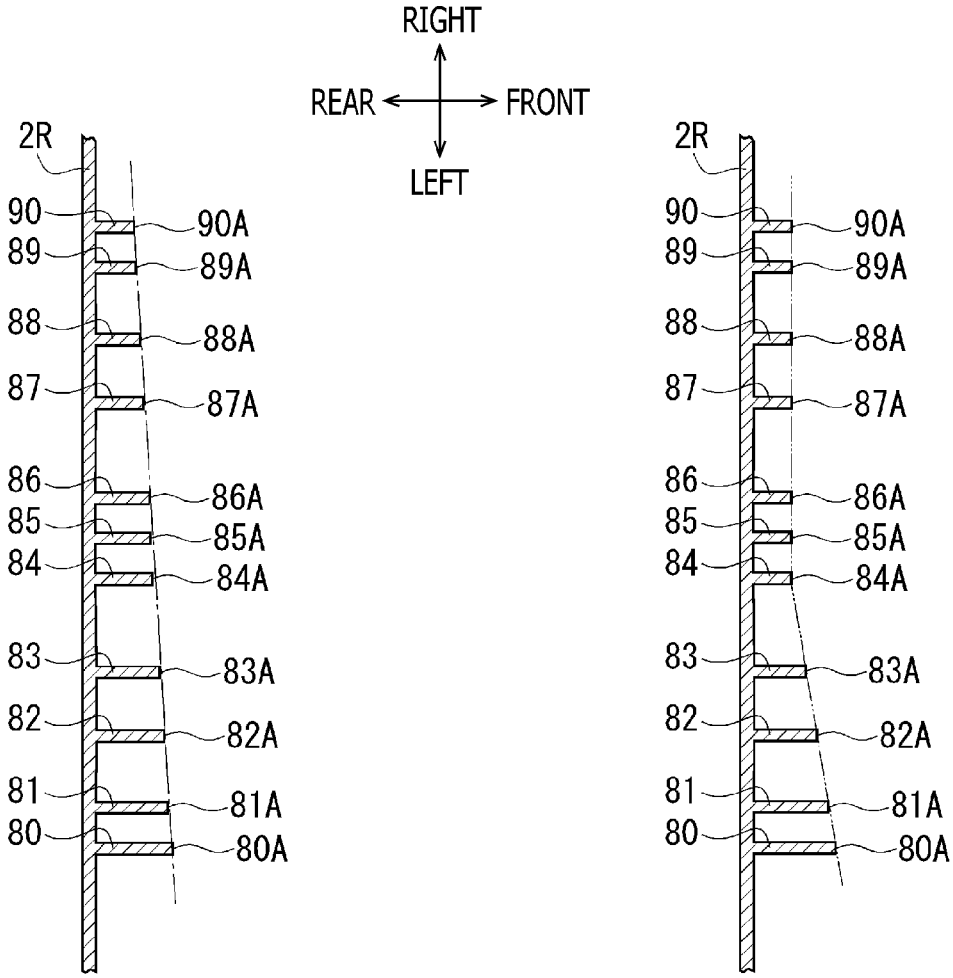
FIG. 8A is a cross-sectional top view showing a relative-position relationship among respective distal end surfaces of the ribs in a modification according to one or more aspects of the present invention.
FIG. 8B is a cross-sectional top view showing a relative-position relationship among the distal end surfaces of the ribs in another modification according to one or more aspects of the present invention.

The ribs 80 to 90 may be configured to have respective forward-protruding lengths from the rear cover 2R to the distal end surfaces 80A to 90A as shown in FIG. 8A or 8B.

Specifically, as shown in FIG. 8A (which is a cross-sectional top view of the ribs 80 to 90 and the rear cover 2R along the virtual plane K1 in a modification according to aspects of the present invention), the ribs 80 to 90 may be configured to have respective different forward-protruding lengths from the rear cover 2R to the distal end surfaces 80A to 90A, the lengths becoming gradually shorter toward the rightmost rib 90 (the distal end surface 90A) from the leftmost rib 80 (the distal end surface 80A).

Further, as shown in FIG. 8B (which is a cross-sectional top view of the ribs 80 to 90 and the rear cover 2R along the virtual plane K1 in another modification according to aspects of the present invention), the ribs 80 to 83 may be configured to have respective different forward-protruding lengths from the rear cover 2R to the distal end surfaces 80A to 83A, the lengths becoming gradually shorter toward the rib 83 (the distal end surface 83A) from the leftmost rib 80 (the distal end surface 80A). Moreover, the ribs 84 to 90 may be configured to have the same forward-protruding length from the rear cover 2R to the distal end surfaces 84A to 90A.

In the aforementioned embodiment, the first feeding route R1 is formed with the distal end surfaces of the ribs 80 to 90, and the second feeding route R2 is formed with the distal end surfaces of the ribs 64. However, the first feeding route R1 may be formed with a curved surface that is continuous in the feeding direction and the width direction of the sheet 99. Further, the second feeding route R2 may be formed with a curved surface that is continuous in the feeding direction and the width direction of the sheet 99. For instance, a flat guide plate may be curved along each shape of the first feeding route R1 and the second feeding route R2. Alternatively, a resin material may be formed in the same shape as the curved guide plate.

In the aforementioned embodiment, the regulating member 69 and the first regulating surface 71 are formed as separated members. However, the regulating member 69 and the first regulating surface 71 may be formed as an integrated single member. In this case, the second regulating member 72 and the third regulating member 73, as guide members, may be attached to the first regulating surface 71.

In the aforementioned embodiment, the sheet 99 is fed from the first feeding route R1 onto the second feeding route R2 by the ejection rollers 41 and 42 that double as the turn-around mechanism. However, the sheet 99 may be fed from the first feeding route R1 onto the second feeding route R2 by one or more feed rollers, which may be provided around an upper end of the first feeding route R1.

In the aforementioned embodiment, the image forming unit 10 is configured to perform image formation in an electrophotographic method. However, the image forming unit 10 may be configured to perform image formation in one of various methods such as an inkjet method and a thermal method. Further, the printer 1 may be configured with a near side of the sheet of FIG. 1 as a front side of the printer 1.

What is claimed is:

1. An image forming apparatus comprising:

an image forming unit configured to form an image on a sheet being fed;

a turn-around mechanism configured to turn around a feeding direction of the sheet with a first image formed on a first face thereof by the image forming unit; and a re-feeding unit configured to re-feed, to the image forming unit, the sheet after the feeding direction is turned around by the turn-around mechanism, such that the image forming unit can form a second image on a second face opposite to the first face of the sheet, the re-feeding unit comprising:

a first feeding unit comprising a guide curved to bulge in such a direction as to be farther from the image forming unit, the guide defining an outer side of a curved first feeding route configured to feed the sheet received from the turn-around mechanism downstream in the feeding direction; and a second feeding unit defining a second feeding route configured to feed the sheet fed via the first feeding route, to an upstream side of the image forming unit in the feeding direction, the second feeding unit comprising a regulating member configured to define a first side of the second feeding route in a width direction perpendicular to the feeding direction of the sheet and to regulate a position of an end of the sheet on the first side of the second feeding route in the width direction, wherein the guide of the first feeding unit comprises:

a first section on the first side thereof in the width direction; and a second section on a second side opposite to the first side thereof in the width direction, the second section being curved to bulge more than the first section in such a direction as to be farther from the image forming unit;

wherein the guide of the first feeding unit further comprises a plurality of ribs arranged in the width direction and formed to protrude toward the image forming unit in a protruding direction, the plurality of ribs comprising:

a first-side outermost rib that is an outermost rib on the first side of the guide in the width direction, wherein a concave-most portion of a distal end surface of the first-side outermost rib is closest to the image forming unit in the protruding direction among all concave-most portions of distal end surfaces of the plurality of ribs;

a second-side outermost rib that is an outermost rib on the second side of the guide in the width direction, wherein a concave-most portion of a distal end surface of the second-side outermost rib is farthest from the image forming unit in the protruding direction among all the concave-most portions of the distal end surfaces of the plurality of ribs, wherein the first section of the guide comprises a plurality of first ribs of the plurality of ribs, the plurality of first ribs including the first-side outermost rib, wherein the second section of the guide comprises a plurality of second ribs of the plurality of ribs, the plurality of second ribs including the second-side outermost rib, and wherein concave-most portions of distal end surfaces of the plurality of second ribs are farther from the image forming unit in the protruding direction than concave-most portions of distal end surfaces of the plurality of first ribs; and wherein the plurality of ribs have respective different protruding lengths from a base of the respective rib to the concave-most portion of the distal end surface of the respective rib, such that the protruding lengths become smaller for each subsequent rib arranged towards the second side from the first side in the width direction.

2. The image forming apparatus according to claim 1, wherein the regulating member comprises:

a linear surface extending linearly along the feeding direction of the sheet; and a first regulating surface that is disposed at an end of the linear surface closest to the guide, the first regulating surface extending toward the first feeding route in a slanted manner from the linear surface toward the first side in the width direction.

3. The image forming apparatus according to claim 2, wherein the regulating member comprises a guide member disposed at an end thereof disposed closest to the first feeding route, and wherein the guide member comprises:

the first regulating surface; and a second regulating surface which extends from the first regulating surface toward the second side in the width direction and which is configured to guide the sheet from the guide of the first feeding route onto the second feeding route.

4. The image forming apparatus according to claim 3, further comprising a plurality of guide ribs arranged in the width direction, the plurality of guide ribs being formed to protrude toward the image forming unit such that respective distal end surfaces of the protruding guide ribs define the second feeding route, wherein the second regulating surface is curved to be substantially positionally coincident with the distal end surfaces of the guide ribs when viewed along the width direction.

5. The image forming apparatus according to claim 3, wherein the guide member further comprises a third regulating surface that is disposed to face the second regulating surface across the second feeding route and which extends from the first regulating surface toward the second side in the width direction.

6. The image forming apparatus according to claim 1, wherein the guide comprises:

a middle section disposed at middle portions of the distal end surfaces of the plurality of ribs in the feeding direction of the guide, the middle section being curved to bulge in such a direction as to be farther from the image forming unit; and an end section disposed at ends of the distal end surfaces of the plurality of ribs closest to the second feeding route, wherein the distal end surface of each of the plurality of ribs at the end section is closer to the second feeding route in the protruding direction than the middle portions of the distal end surfaces of the plurality of ribs at the middle section.

7. The image forming apparatus according to claim 6, wherein the end section of the first section and the end section of the second section are positionally coincident with each other when viewed along the width direction.

8. The image forming apparatus according to claim 1, further comprising a tray disposed substantially parallel to the feeding direction when the image is formed on the sheet, wherein the second feeding route is formed on the tray.

9. The image forming apparatus according to claim 1, further comprising:

a housing configured to accommodate the image forming unit, the turn-around mechanism, and the re-feeding unit; and a cover attached to the housing in an openable and closable manner, wherein the guide is provided on a side of the cover that faces the image forming unit when the cover is closed.

10. The image forming apparatus according to claim 1, further comprising a feeding member configured to apply, to the sheet being fed on the second feeding route, a feeding force such that the sheet is fed downstream in the feeding direction while being pulled toward the regulating member.

11. The image forming apparatus according to claim 1, wherein the second feeding unit further comprises a plurality of guide ribs arranged in the width direction, the plurality of guide ribs being formed to protrude toward the image forming unit such that respective distal end surfaces of the protruding guide ribs define the second feeding route, and wherein ends of the plurality of ribs of the guide of the first feeding unit on a side of the ribs disposed closest to the second feeding route are positionally coincident with ends of the guide ribs of the second feeding unit on a side of the guide ribs disposed closest to the first feeding route when viewed along the width direction.

* * * * *